US005230585A

United States Patent [19]

Fujisawa et al.

[11] Patent Number: 5,230,585

[45] Date of Patent: Jul. 27, 1993

[54] MOUNT STRUCTURE FOR A FLEXIBLE MEMBRANE WEIR

[75] Inventors: Masao Fujisawa, Chigasaki; Yoshihiro Sato, Yokohama, both of Japan

[73] Assignee: Bridgestone Corporation, Tokyo, Japan

[21] Appl. No.: 899,473

[22] Filed: Jun. 16, 1992

[30] Foreign Application Priority Data

Jul. 22, 1991 [JP] Japan ..... 3-204564

[51] Int. Cl.[5] ..... E02B 7/04

[52] U.S. Cl. ..... 405/115; 405/91

[58] Field of Search ..... 405/115, 114, 91, 107, 405/108, 87

[56] References Cited

U.S. PATENT DOCUMENTS 3,246,474 4/1966 Mesnager ..... 405/115
4,279,540 7/1981 Suga et al. ..... 405/115

FOREIGN PATENT DOCUMENTS 0379327 1/1990 European Pat. Off. .
62-7694 2/1987 Japan .
0111515 8/1990 Japan ..... 405/115
887137 6/1960 United Kingdom .
2030624 9/1979 United Kingdom .
2088935 8/1981 United Kingdom .

OTHER PUBLICATIONS

Patent Abstracts of Japan, vol. 10, No. 181 (M-492)(2237) 25 Jun. 1986 & JP-A-6128609 (Sumitomo Electric Ind Ltd.).

Patent Abstracts of Japan, vol. 11, No. 140 (M-586)(2587) 7 May 1987 & JP-A-61277711 (Bridgestone Corp.).

*Primary Examiner*—Dennis L. Taylor

*Attorney, Agent, or Firm*—Sughrue, Mion, Zinn, Macpeak & Seas

[57] ABSTRACT

A structure for mounting a flexible membrane weir to banks 2 and a crest 1 formed on a river bed between the above-mentioned banks and having a crest surface 1*a* of arc shape in cross-section. A trigonal-pyramid-shaped fillet 3 is provided at an intersecting portion between a crest surface on the upstream side of the top of the crest and the bank, and an upstream side edge of a toe of slope 5*a* of a flexible membrane 5 is fixed to this fillet 3.

7 Claims, 4 Drawing Sheets

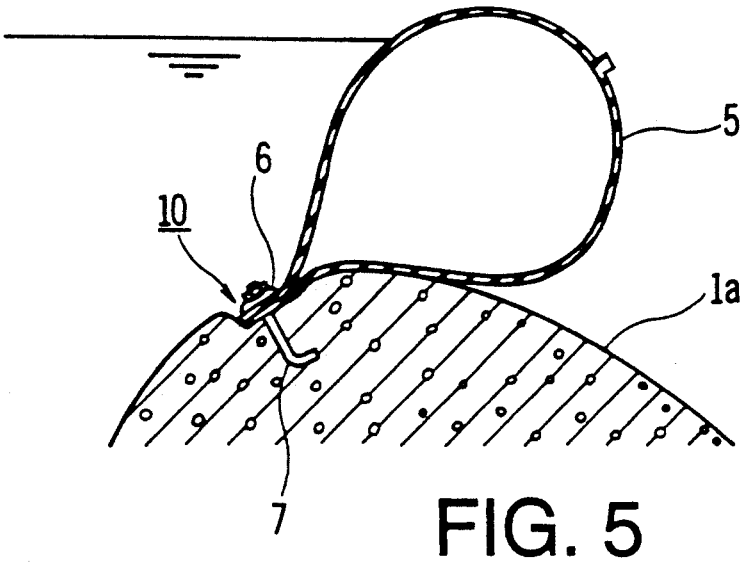
FIG. 5
FIG. 6 PRIOR ART
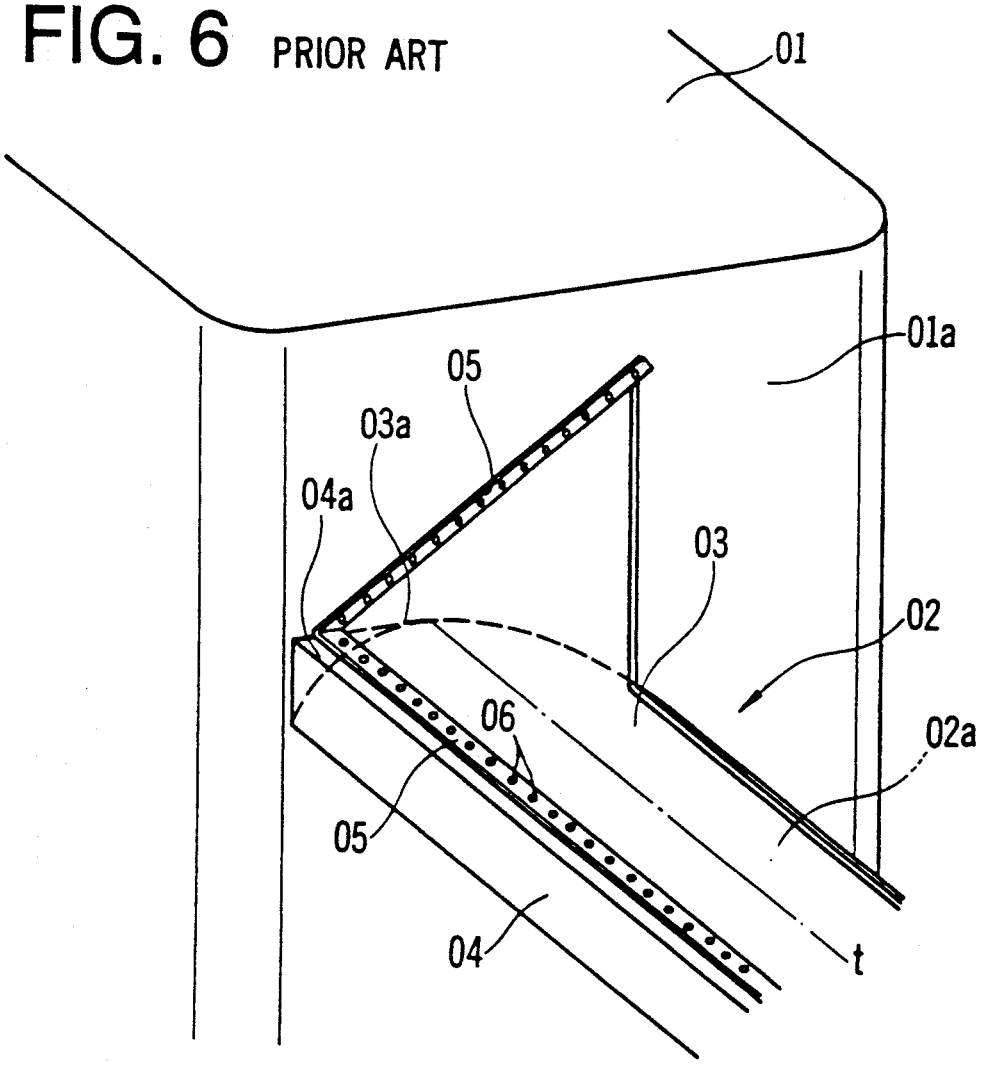

MOUNT STRUCTURE FOR A FLEXIBLE MEMBRANE WEIR

BACKGROUND OF THE INVENTION

1. Field of the Invention

The present invention relates to a flexible membrane weir capable of adjusting a water level which is normally called "rubber weir". More particularly it relates to a mount structure for mounting such membrane weir onto a dam crest.

2. Description of the Prior Art

One example of the heretofore known structure for mounting a rubber weir onto an existing dam crest is shown In FIG. 6. Referring to this figure, a dam crest 02 having a crest surface 02*a* of arc shape in cross-section is formed on a river bed between banks 01 on the respective sides of a river.

A pedestal 04 having its top surface 04*a* formed of a horizontal plane extending horizontally from a top line t (dash-dot line) of the crest surface 02*a* to the upstream side, is formed over the entire length in the widthwise direction of the river bed. A superimposed free end of a twice-folded rubber membrane 03 is placed on the top surface 04*a* of this pedestal 04, and it is fixed to anchor bolts 06 as pressed by a fixing metal 05.

Since the free end on the upstream side of the rubber membrane 03 is fixed onto the horizontal top surface 04*a* of the pedestal 04, the mount structure of the rubber membrane 03 becomes similar to that in the case of mounting it onto a planet river bed. Thus, when the rubber membrane 03 falls, it can fall without its toe of slope 03*a* forming excessive protrusions on the top surface 04*a* of the pedestal 04 nor on the face of slope 01*a* of the bank 01. As a result a fitting property of the rubber membrane 03 becomes good, hence smooth flow of river water can be realized, and an excessive force would not act upon the rubber membrane 03.

However, since the configuration of the crest 02 changes over the entire length in the widthwise direction of the river bed as a result of provision of the pedestal 04, a coefficient of discharge would lower by about 10%. In addition, since the pedestal 04 extends over the entire length in the widthwise direction of the river bed, a cost of construction as well as a period of construction would be increased.

SUMMARY OF THE INVENTION

The present invention has been made in view of the above-described points, and it is one object of the present invention to provide a mount structure for a flexible membrane weir, in which upon mounting a flexible membrane weir onto banks and onto a crest formed on a river bed between the banks, a cost of construction as well as a period of construction can be reduced, degradation of a coefficient of discharge would scarcely occur, and a fitting property at the time of falling is also good.

In order to achieve the above-mentioned object, according to one feature of the present invention, there is provided a mount structure for mounting a flexible membrane weir onto banks and a dam crest formed on a river bed between the banks, in which trigonal-pyramid-shaped fillets are provided at intersecting portions between the above-mentioned crest surface on the upstream side of the top of the same crest and the banks, and an upstream side end portion of a toe of slope of the flexible membrane is fixed to the aforementioned fillets.

Since the fillets are present only at the opposite ends in the widthwise direction of the river bed, lowering of a coefficient of discharge is little, a cost of construction as well as a period of construction can be reduced, and a fitting property of the membrane onto the crest surface and the face of slope of the bank is also improved.

BRIEF DESCRIPTION OF THE DRAWINGS

In the accompanying drawings:

FIG. 5 is a cross-section side view showing a mount structure for a rubber weir in another preferred embodiment of the present invention; and FIG. 6 is a perspective view showing a mount structure for a rubber weir in the prior art.

DESCRIPTION OF THE PREFERRED EMBODIMENTS

Now description will be made on one preferred embodiment of the present invention illustrated in FIGS. 1 to 4.

Figure 1:
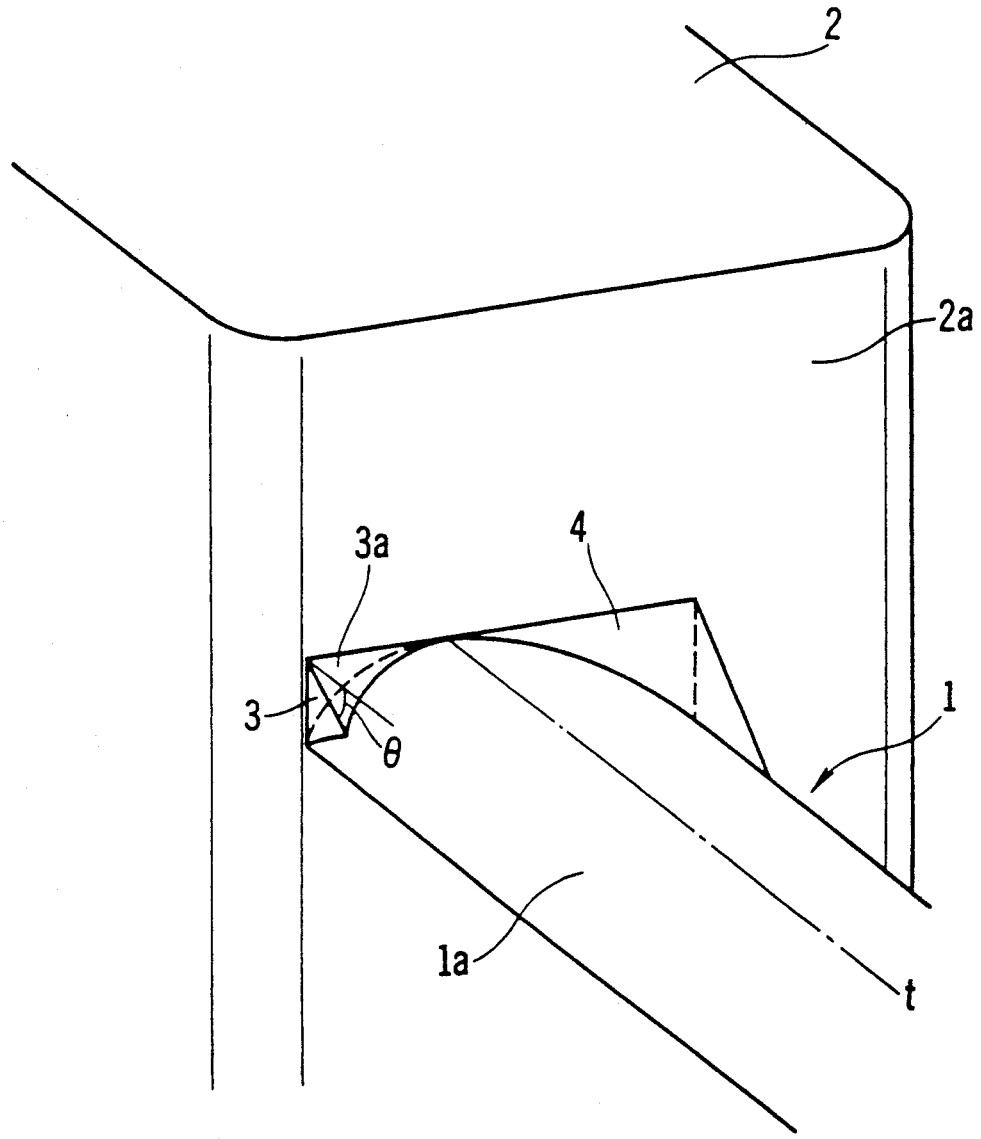
FIG. 1 is a perspective view of a dam crest portion in one preferred embodiment of the present invention.
Figure 2:
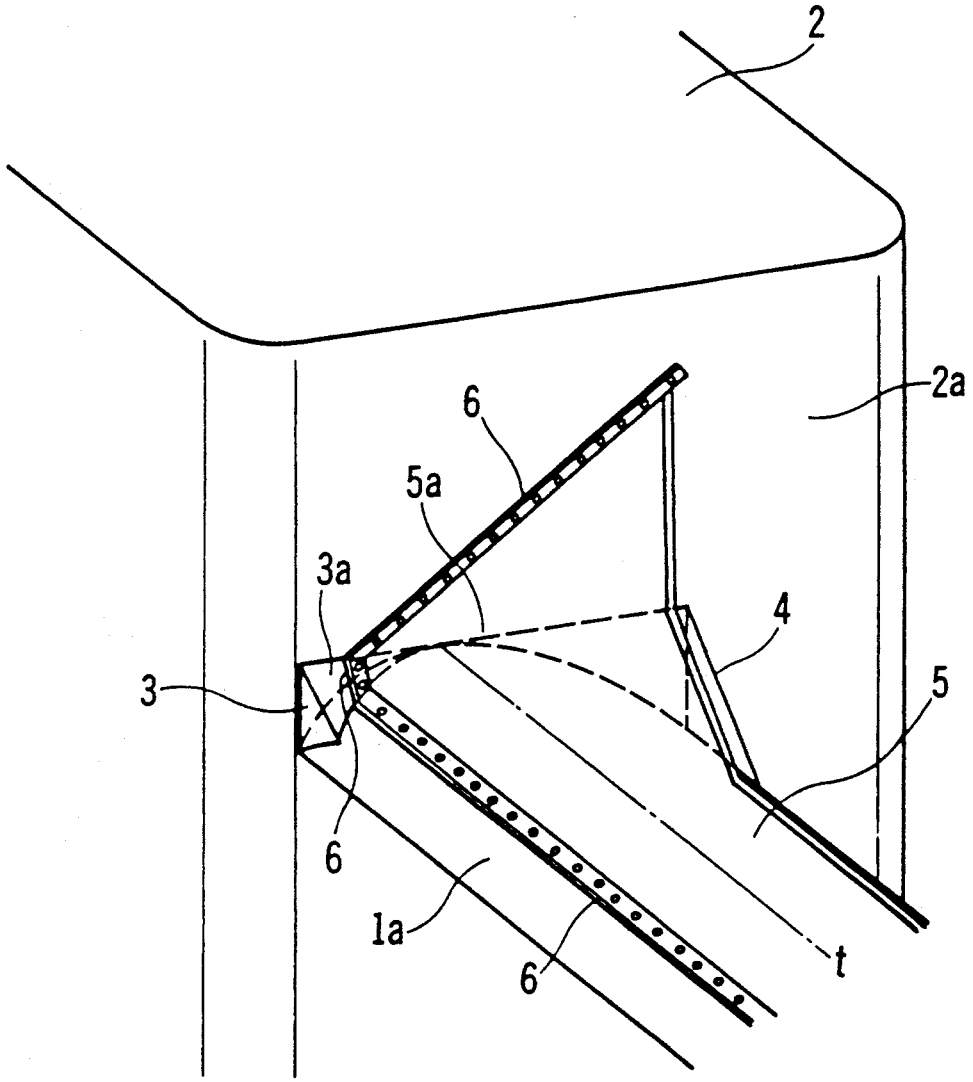
FIG. 2 is a perspective view showing the state where a rubber weir has been mounted onto the same dam crest portion.
Figure 3:
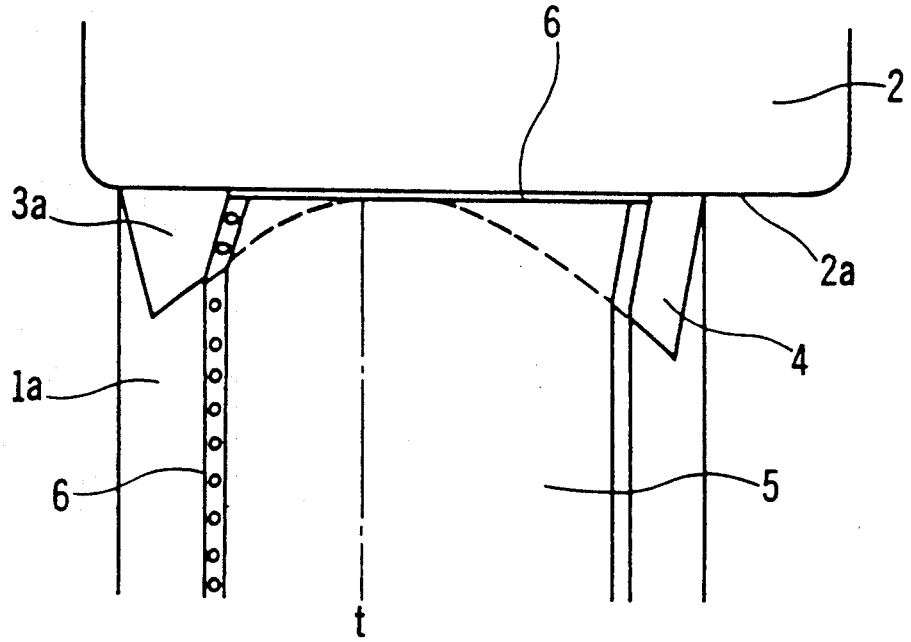
FIG. 3 is a plan view of the same rubber weir.
Figure 4:
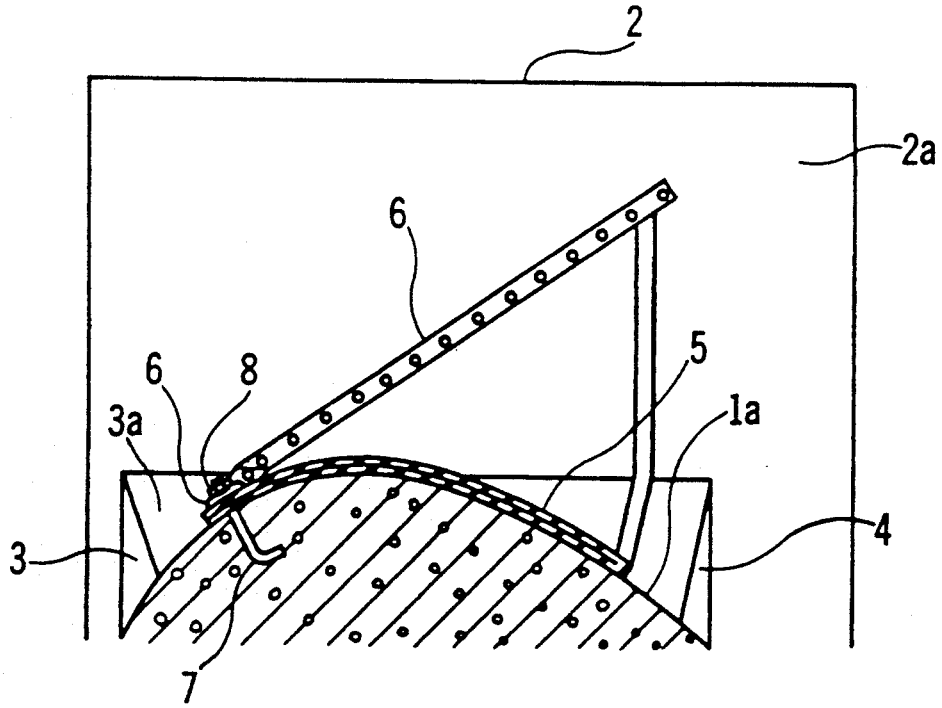
FIG. 4 is a cross-section side view of the same rubber weir.

FIG. 1 is a perspective view showing a crest 1 formed on a river bed and a bank 2 before a rubber membrane 5 serving as a rubber weir is mounted. The crest 1 has a crest surface 1*a* of arc shape in cross-section, and the bank 2 forms a nearly vertical face of slope 2*a*.

On the upstream side (on the left side in FIG. 1) of a top line t (dash-dot line) of the crest surface 1*a*, a fillet 3 is formed at an intersecting portion between the crest 1 and the bank 2. In addition, in this particular embodiment, on the downstream side of the top line t is also formed a trigonal-pyramid-shaped fillet 4.

The fillet 3 has a trigonal pyramid shape formed of four surfaces consisting of a face of slope 2*a* of the bank 2, a surface 1*a* of the crest 1, a fillet upper surface 3*a* and an upstream side vertical plane. The upper surface 3*a* has its one edge formed of a horizontal line passing through the end of the top line t on the face of slope 2*a* of the bank 2, and it extends obliquely downwards from that horizontal line towards the crest surface 1*a* at an inclination angle $\theta$ with respect to a horizontal plane. Accordingly, there is formed a fixing metal mount surface which can naturally transfers from the crest surface 1*a* via the inclined fillet upper surface 3*a* to the vertical face of slope 2*a*.

A rubber membrane 5 is twice-folded and disposed on the crest surface 1*a* with the opened free end directed to the upstream side, and has this opened free end fixed onto a curved surface portion on the upstream side of the top line t of the crest surface 1*a* and onto the upper surface 3*a* of the fillet 3. The opposite side ends of the twice-folded rubber membrane 5 are fixed onto the faces of slope 2*a* of the banks 2.

A fixing metal 6 for pressing the superimposed free ends of the rubber membrane from the above, is laid on the crest surface 1*a* along the curved surface portion on the upstream side in parallel to the top line t. The opposite end portions of this fixing metal 6 are laid as bent somewhat upwards along the inclined upper surface 3*a* of the fillet 3, and reach the vertical faces of slope 2*a* of the banks 2, and then, on these faces of slope 2*a* they are laid obliquely upwards towards the downstream side.

On the crest surface 1*a*, fillet upper surfaces 3*a* and faces of slope 2*a* are placed studed anchor bolts 7 at a predetermined interval along the lines on which the above-mentioned fixing metal 6 is laid. The projected portions of these anchor bolts 7 are made to penetrate through the free end portion of the rubber membrane 5. Further they are made to penetrate through the fixing metal 6, nuts 8 are threadedly engaged with the exposed head portions of the anchor bolts 7, and the free end of the rubber membrane 5 is adapted to be fixed by fastening the nuts 8 (See FIG. 4).

As described above, since the fixing metal 6 laid from the crest surface 1*a* up to the vertical face of slope 2*a* for fixing the free end of the rubber membrane 5 can be naturally bent and fixed by passing the inclined upper surface 3*a* of the fillet 3, the toe of slope 5*a* of the rubber membrane 5 also naturally fits the crest surface 1*a*, fillet upper surfaces 3*a* and faces of slope 2*a*.

In the illustrated embodiment, a fillet 4 is provided also on the downstream side of the crest surface 1*a*. This fillet 4 supports the toe of slope 5*a* on the downstream side of the rubber membrane 5 at the time of falling, and thereby prevents the toe of slope 5*a* from floating up from the crest surface 1*a* and the faces of slope 2*a*.

As the fillets 3 are provided only at the intersecting portions with the faces of slope 2*a* at the opposite ends of the crest surface 1*a*, it would never occur that the configuration of the crest surface 1*a* is varied greatly by these fillets 3, and lowering of a coefficient of discharge is little. Since most of the crest surface 1*a* is held at the existing state and the fixing metal 6 is fixed along the existing crest surface, a cost of construction can be reduced, and a period of construction also can be shortened.

A modification could be made such that a groove 10 may be provided at the portion of the crest surface 1*a* where a fixing metal 6 is laid and the fixing metal may fix the free end of the rubber membrane 5 within the groove 10 as shown in FIG. 5. By making such a modification, overflowing at the time of falling becomes smooth, and it can be avoided that flowing stones or the like may strike directly against the fixing metal 6.

While the faces of slope 2*a* of the banks 2 were vertical in the above-described embodiment, it is a matter of course that the present invention is naturally applicable also to a construction in which an inclined face of slope is formed.

What is claimed is:

1. A dam structure comprising; banks provided on opposite sides of a water stream and having opposing faces facing said water stream, a dam crest formed between said faces and having a crest surface arc shape in cross-section, a flexible membrane weir mounted onto said faces of the banks and said crest surface, trigonal-pyramid-shaped fillets provided on intersecting portions between one of said faces and said crest surface at an upstream side of said water stream with respect to a top of said crest surface, each of said fillets having an inclined upper surface connecting a respective face with said crest surface, and said flexible membrane weir is fixed onto said faces and said crest surface through said inclined upper surface of each fillet.

2. A dam structure as claimed in claim 1, wherein each of said faces has a vertical slope.

3. A dam structure as claimed in claim 1, wherein each of said faces is inclined with respect to vertical.

4. A dam structure as claimed in claim 1, wherein said upper surface of each fillet has its one edge formed of a horizontal line passing through an end of a top line of said crest surface on each of said faces of the banks, and extends obliquely downwards from said horizontal line towards said crest surface at a predetermined inclination angle with respect to a horizontal plane.

5. A dam structure as claimed in claim 1, wherein an edge portion of said flexible membrane weir on upstream side of the water stream is fixed onto a crest surface portion on said upstream side with respect to a top line of said crest surface and onto said upper surface of the fillet continuously from said crest surface up to said upper surface.

6. A dam structure as claimed in claim 5, wherein a groove is provided in said crest surface portion where said edge portion of said flexible membrane weir is to be fixed, and within said groove said edge portion is fixed by means of a fixing metal.

7. A dam structure as claimed in claim 1, wherein a trigonal-pyramid-shaped fillet is also provided at an intersecting portion between said crest surface and said face on a downstream side of the water stream with respect to said top of the crest surface.

* * * * *